US005396734A

United States Patent [19]

Frey

[11] Patent Number: 5,396,734

[45] Date of Patent: Mar. 14, 1995

[54] DEVICE FOR DIVIDING FLOOR COVERINGS AT A DOOR OPENING

[76] Inventor: Harry Frey, Untere Gasse 24, D-8950 Kaufbeuren-Oberbeuren, Germany

[21] Appl. No.: 56,402

[22] Filed: May 4, 1993

[30] Foreign Application Priority Data

May 6, 1992 [DE] Germany ..... 42 14 473.6

[51] Int. Cl.[6] ..... E06B 1/70

[52] U.S. Cl. ..... 49/469; 49/470; 49/501; 52/459; 52/393; 52/410

[58] Field of Search ..... 49/468, 404, 467, 469, 49/470, 505, 471, 501, 478.1; 52/393–397, 400, 410, 459, 126.02, 126.07, 480, 710, DIG. 4

[56] References Cited

U.S. PATENT DOCUMENTS

| | | | |
|---|---|---|---|
| 1,795,853 | 3/1931 | Glass | 49/470 |
| 2,010,609 | 8/1935 | Shogren | 49/471 |
| 2,818,614 | 1/1958 | Lapka, Jr. . | |
| 2,837,786 | 6/1958 | Fryar, Jr. . | |
| 3,013,314 | 12/1961 | Beltz et al. | 49/469 |
| 3,079,652 | 3/1963 | Wahlfeld | 49/469 |
| 3,402,512 | 9/1968 | Peterson . | |
| 3,443,350 | 5/1969 | Birum, Jr. | 52/459 |
| 4,612,743 | 9/1986 | Salzer | 49/501 |
| 4,702,038 | 10/1987 | Frey | 49/478 |

FOREIGN PATENT DOCUMENTS

| | | | |
|---|---|---|---|
| 379859 | 3/1986 | Austria . | |
| 0907348 | 8/1972 | Canada | 49/468 |
| 0138770 | 4/1985 | European Pat. Off. . | |
| 1347549 | 11/1963 | France | 49/469 |
| 1916635 | 11/1970 | Germany . | |
| 2806285 | 8/1979 | Germany | 49/467 |
| 33 04 685 | 8/1984 | Germany . | |
| 35 27 113 | 1/1987 | Germany . | |
| 37 08 176 | 11/1988 | Germany . | |
| WO8401598 | 4/1984 | WIPO . | |

*Primary Examiner*—Carl D. Friedman
*Assistant Examiner*—Winnie Yip
*Attorney, Agent, or Firm*—Jacobson, Price, Holman & Stern

[57] ABSTRACT

A device for dividing coverings on a floor at a door opening, comprises a rail sunk into the floor across the door opening. The rail has a substantially uniform H-shaped cross-section, comprising a cross-member with first arms extending upwardly therefrom to define a first groove and second arms extending downwardly therefrom to define a second groove. A magnetic sealing strip is received within the first groove and is vertically moveable within it. A set screw extends upwardly into the second groove and engages a nut which is held within the second groove.

10 Claims, 5 Drawing Sheets

DEVICE FOR DIVIDING FLOOR COVERINGS AT A DOOR OPENING

BACKGROUND OF THE INVENTION

1. Technical Field of the Invention

The invention relates to a device for dividing floor coverings by means of a vertically adjustable rail having a substantially uniform cross section, extending under a door and sunk into the floor.

2. Brief Description of the Prior Art

Devices, e.g. rails, strips or the like, are generally applied between different floor coverings in adjoining rooms in order to define each floor covering. These dividing rails often also serve to form a threshold and also to improve the seal of the door closure. A device of this kind of threshold rails on doors is disclosed in DE-A 33 04 685.9 and in DE-A 35 27 113.2.

In order to ensure that these rails are fixed securely during installation, they must be arranged in such a manner that they are not displaced, e.g. until the floor covering has secured the rails sufficiently. They are generally fixed to the inner face of the door opening or to a previously mounted metal frame.

It is often desirable to provide additional seals on doors in order, in particular, to close the gap under the door securely and thereby to prevent draughts. A device of this kind is disclosed in, for example, DE-A 37 08 176.

SUMMARY OF THE INVENTION

An object of the invention is to provide a device which satisfies the various requirements of rail-like devices of this kind in the region of the door.

Another object of the invention is to provide a device which is versatile.

A further object of the invention is to provide a device, mounting of which is as simple as possible, so that it can be installed in a simple manner, even by unskilled workers.

In order to solve this problem, the invention is based on a device as disclosed in DE-A 33 04 685.9. It is proposed according to the invention that the rail has a substantially H-shaped design, comprising a crossbar and arms projecting upwards and downwards from the crossbar. The upwardly projecting arms and the crossbar together forming a receiving groove for a magnetic sealing strip which can be raised and can be moved in the groove. The arms projecting downwards from the crossbar guide, in recesses, a polygonal nut for a set screw which stands on the sub-floor.

The device according to the invention provides excellent division of the floor coverings in adjoining rooms or even on an entrance door between the external covering and the covering in the hall or the like. Vertical adjustment of the rail, i.e. aligning it with the finished floor, is carried out in the invention by a simple screwing process. Two set screws are generally used, in the vicinity of the ends of the rail. However, it is also possible to provide more set screws, e.g. in the case of a rail of larger dimensions. As the strip has a uniform cross section, the set screws can be inserted laterally with the nuts.

The device according to the invention also provides means for sealing the gap under the door. This has the advantage that the sealing device is sunk into the floor, i.e. it does not form any upwardly projecting stop.

The receiving groove for the magnetic sealing strip can also be used to support stationary side portions or wall portions on either side of the door. For example, a square profile of sufficient height can be inserted into the receiving groove, which profile supports the side portions through its upper region. The inserted profile can consist, for example, of plastics, whereby side or wall portions made of wood can be connected to the rail.

The device according to the invention can also be readily used when the adjoining floors are of different heights, so that a gradation must be provided.

DETAILED DESCRIPTION OF THE INVENTION

The recesses for the polygonal nut are preferably designed in such a manner that they form shoulders, so that the rail can rest on the polygonal nuts. It is particularly advantageous in this connection for the downwardly projecting arms to have opposing U-shaped receiving grooves for the polygonal nut. This facilitates installation as the grooves surround the nuts and prevent them from dropping out.

In order to connect the rail to the inner face of the door opening or the metal frame which receives the door, it is advantageous for a dovetailed groove to be provided on the inner face of one of the downwardly projecting arms. A resilient element can be inserted into a groove of this kind, as is known from DE-A 33 04 685.9. This resilient element can then be secured to the masonry.

It is further advantageous for another dovetailed groove to be provided on an outer face of one of the downwardly projecting arms. This groove can receive a strip, by means of which the device according to the invention can be fixed to a metal frame mounted in the door opening. The strip can also be magnetic, so that adhesion to the metal frame is obtained without additional measures. The usual means then serve for precise securing, e.g. screws, clamps, or even mortar or the like. The set screw used in the invention can be a conventional screw. However, the set screw is preferably provided at its lower end with a base plate by means of which it stands on the sub-floor. In this case, the set screw is preferably made of plastics material, in order to achieve good sound and thermal insulation. The nut used by the invention, on the other hand, can be a conventional hexagonal nut made of metal.

According to a further feature of the invention, a metal piece having a C-shaped cross section can serve as the base plate. This profile section, like the rail, receives a polygonal nut or a screw head. The profile section can then be rigidly connected to the set screw with a lock nut.

Particularly if the rail according to the invention is to be used on an external door, it is advisable to provide an extension on the downwardly projecting arm which can be broken off at breaking notches. In this manner, firm and permanent division of the interior and exterior can be simply achieved.

Fixing means, in particular a downwardly-open receiving groove for an insulating strip on the outer face of one arm, also serve this end.

An angled plate which serves to support the insulating strip can also be arranged in the receiving groove for the insulating strip. Such an angled plate preferably has arms of different lengths with breaking notches so that the plate can be adapted to situations of different dimensions.

In one type of construction, used on external doors, it is further advantageous for the receiving groove of the magnetic sealing strip to have lateral outlet openings on its base. Any moisture penetrating under the door can be collected by these openings and diverted to the exterior.

According to a further feature of the invention, a cover strip is provided for the receiving groove of the magnetic sealing strip. This cover strip has two clamping bars which engage in recesses in the sealing strip, which is inserted in an inverted manner into the groove, and clamp the sealing strip in the groove under deformation.

The proposal according to the invention enables the device to be completely mounted, even where the finishing of the floors, doors, etc. is not yet far advanced. The cover strip prevents contamination of the receiving groove and damage to the sealing strip during construction work. If the door is mounted, the cover strip is removed and the magnetic strip is simply turned round and brought into the operating position. Then only the magnetic counterpart has to be mounted in an appropriate manner on the bottom edge of the door.

DETAILED DESCRIPTION OF PREFERRED EMBODIMENTS

Figure 1:
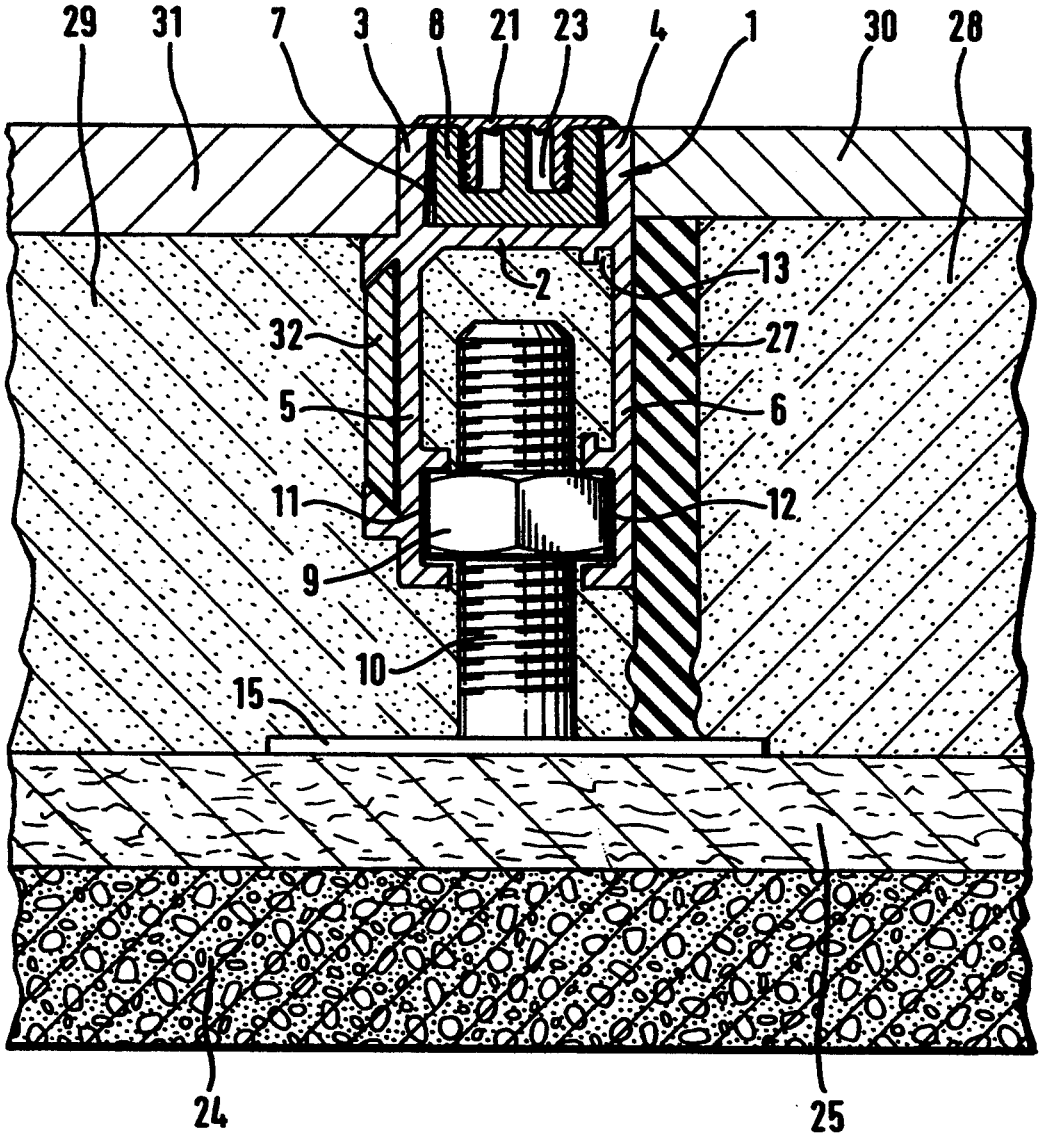
FIG. 1 is a section through a device according to the invention after mounting.

Referring first to FIG. 1, a footstep sound insulating layer 25 is applied to a sub-floor 24. The base plate 15 of a set screw 10 stands on this insulating layer 25. This set screw 10 is screwed into a hexagonal nut 9 of conventional design. The hexagonal nut 9 can consist of, e.g., steel. The set screw 10 and the base plate 15 preferably consist of plastics material.

The nut 9 into which the set screw 10 is screwed is held in a rail 1 in two opposing receiving grooves 11,12. Short arms 26 (see FIG. 3) define these receiving grooves. In this arrangement, the set screw 10 can be displaced laterally in the rail 1 together with the nut, so that the rail can be supported by, for example, two or three set screws at different points. The desired vertical position can be set precisely by rotating the set screw.

The base plate 15 can simply be placed on the floor. However, it is also possible to fasten the base plate by pegs or by some other means.

In the embodiment shown in FIG. 1, a foam or cellular rubber strip 27 is stuck onto the outer face of the rail 1. The width of this strip 27 can be adapted to the respective height in a simple manner. If the strip is too wide, the strip concertinas of folds over. Good division of the floor layers 28,29 is achieved by means of the strip 27, thereby ensuring good sound insulation.

The floor coverings in the two adjoining rooms are designated by the reference numerals 30 and 31.

Figure 3:
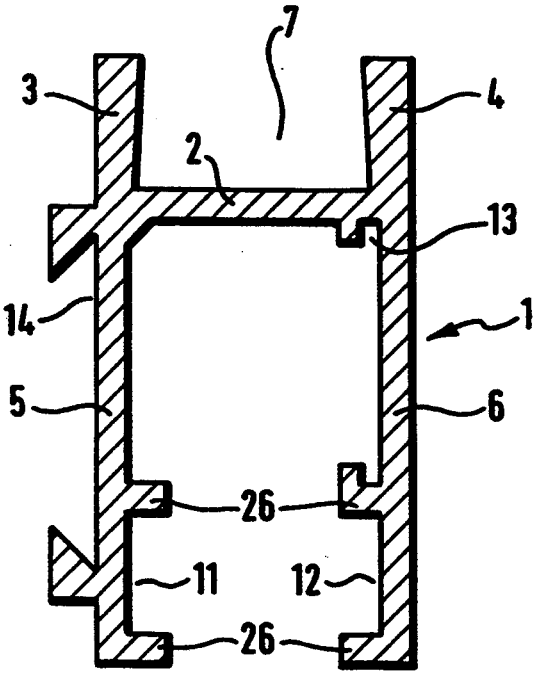
FIG. 3 is a section through a rail forming part of the device of FIG. 1.

The rail 1 used in the invention consists essentially, as can be seen from FIG. 3, of a crossbar 2 with upwardly directed arms 3,4 and downwardly directed arms 5,6. Whereas the downwardly directed arms 5,6 essentially serve to form receiving grooves 11,12 for the set screw 10 and the nut 9, the upwardly directed arms 3,4 and the crossbar 2 together form a groove 7 for a magnetic sealing strip 8. As shown in FIG. 1, the sealing strip 8, which has an E-shaped cross section, is inserted into the groove 7 in an inverted manner and is covered by a cover strip 21. This cover strip has two clamping bars 22 which engage in recesses 23 of the elastically deformable magnetic sealing strip 8 and deform the sealing strip in such a manner that it is clamped in the groove 7. This is facilitated by the fact that the internal walls of the groove 7 taper towards the top.

The rail 1 can be securely and completely mounted. The magnetic sealing strip is protected and is only brought into operation when the door leaf is mounted.

Grooves 13,14 are provided and may be used to ensure correct arrangement of the rail 1 with respect to the door opening 39 or frame or case mounted in the opening 39. The groove 13 is situated oh the inner face of the downwardly directed arm 6 and can receive a leaf spring, by means of which the rail can be fixed in the door opening. This type of construction is used in particular in wooden frames which are only mounted once the floor is finished. If metal frames are provided, the groove 14 is in a shape of dovetail, into which an appropriately shaped strip 32 can be inserted. By virtue of this strip 32 which, e.g. may also be magnetically active, the rail can be secured on the metal frame, in the correct position without further alignment being necessary.

It will be noted that the strip 32 or the spring which is inserted into the groove 13 only occupies the end region of the rail in order to connect the rail to the frame or the wall soffit at that point.

Whereas the embodiment of FIG. 1 is intended for dividing the floors of internal rooms on the same level, the same rail 1 can also be used as a threshold rail.

Figure 2:
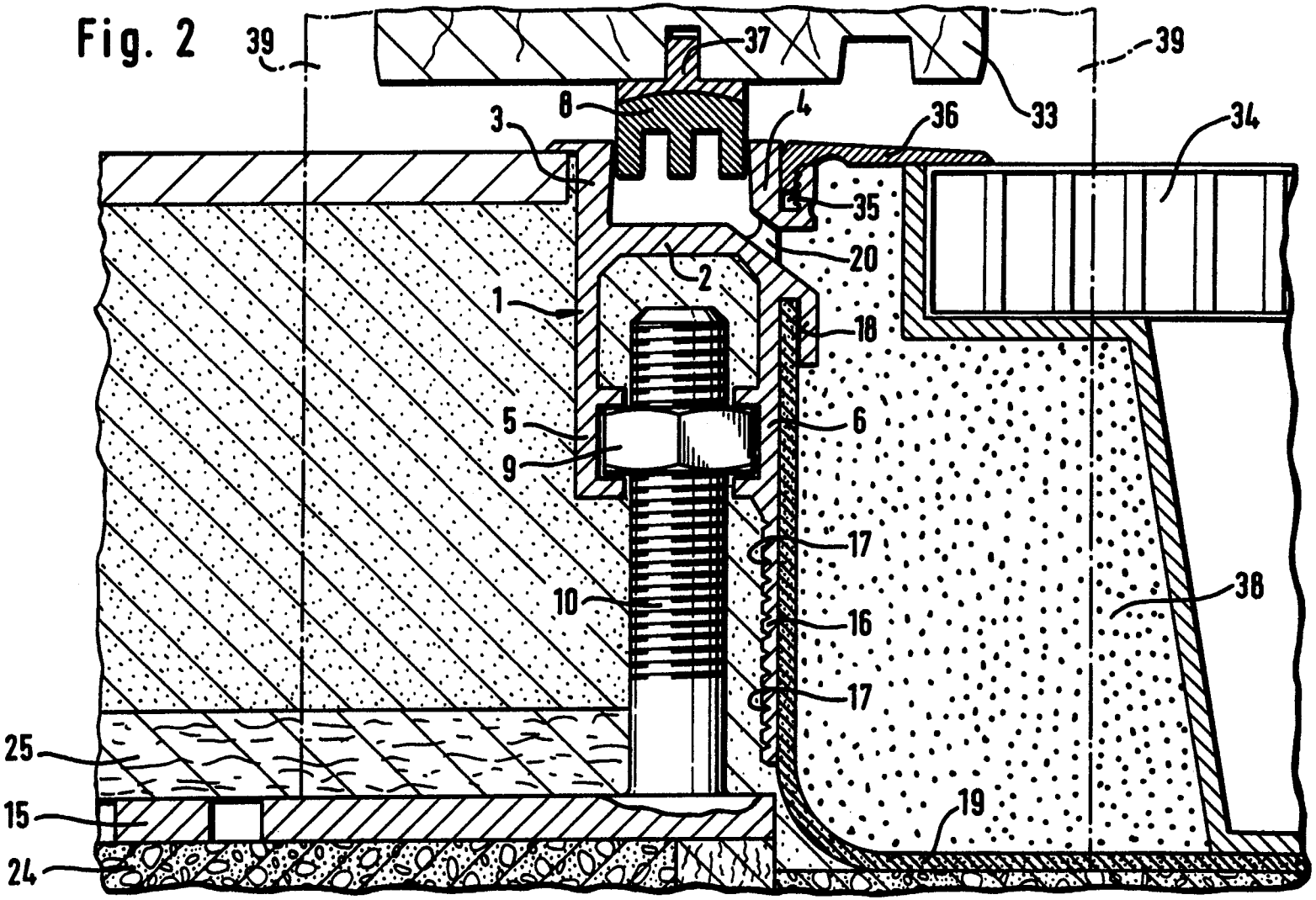
FIG. 2 is a section through a modified embodiment of the invention, in use.
Figure 4:
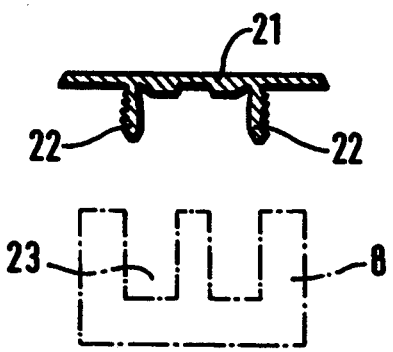
FIG. 4 is a section through a cover strip.

The embodiment of FIG. 2 is a device according to the invention for use on an external door. To this end, it is advisable for the profile of the rail 1 to be slightly modified. In this embodiment, the arm 6 is provided with a downwardly projecting extension 16 having breaking notches 17. The extension can thus be adapted to the height of the floor covering and a solid boundary towards the outside can be obtained.

A receiving groove 18 for an insulating sheet 19 is further provided on the outer face of the arms 6. Outlet openings 20 are provided in the groove 7, by means of which rainwater passing under the door 33 into the groove 7 is diverted towards the outside into a gravel fill 38. The reference numeral 34 designates a water outlet. Another groove 35 for a cover profile 36 pressed into the groove 35 can also be integrally moulded on to the rail 1.

In FIG. 2, the magnetic sealing strip 8 is in the operating position. This sealing strip cooperates with a magnetic counterpart 37 which is inserted in a groove in the underside of the door 33. FIG. 2 shows the raised sealing position of the sealing strip 8. If the door 33 is opened by a certain amount, the magnetic contact between the strip 8 and the magnetic counterpart 37 is interrupted and the sealing strip 8 falls back into the groove 7. In the closed position of the door, on the other hand, the sealing strip 8 springs back towards the top and provides sealing.

In the embodiment of FIG. 2, the base plate 15 for the set screw 10 stands directly on the sub-floor 24, while the footstep sound insulation 25 is situated above the base plate 15. In this case, the base plate 15 is asymmetrical with respect to the set screw 10, whereas in the embodiment of FIG. 1 the base plate can be, for example, disc-shaped.

Figure 5:
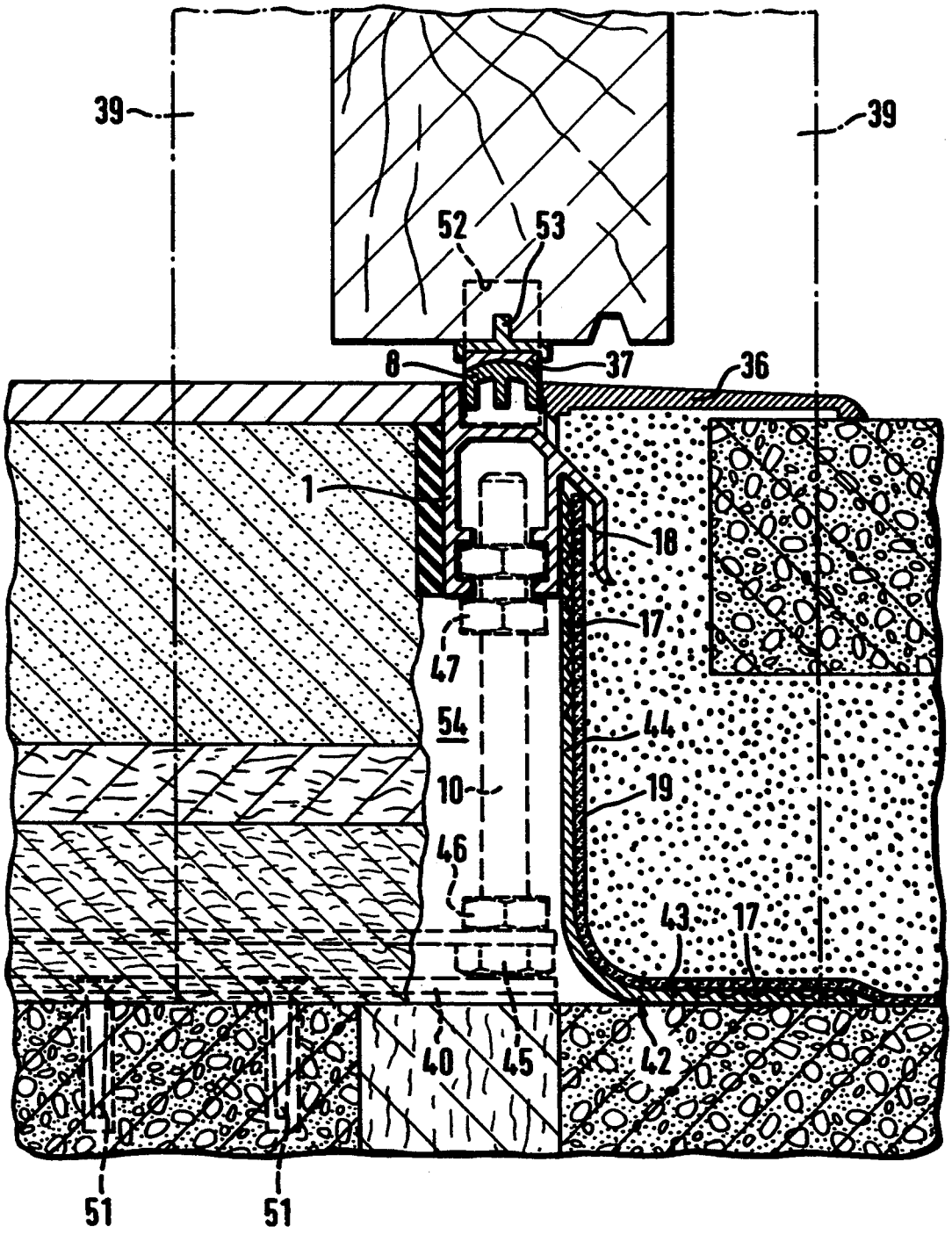
FIGS. 5 and 6 are sections through further embodiments of the invention.

The embodiment of FIG. 5 differs from that of FIG. 2 essentially in that the receiving groove 18 is slightly larger, so that it is able to receive not only the insulating sheet 19, but also an angled plate 42. This angled plate 42 replaces the downwardly projecting extension 16 of the embodiment of FIG. 2 and also has breaking points 17, so that the angled plate 42 can be adapted to the appropriate dimensions. The angled plate 42 has two arms 43,44 of different lengths which in many cases allow rapid adaptation to the respective dimensions without the arms having to be shortened by means of the breaking points 17.

In the embodiment of FIG. 5, the base plate 15 of FIG. 2 is replaced by a profile section 40. This profile section 40 receives the hexagonal screw head 45 of the set screw 10. Lock nuts 46,47 thus provide a firm connection between the rail 1 and the profile section 40 after mounting.

Figure 7:
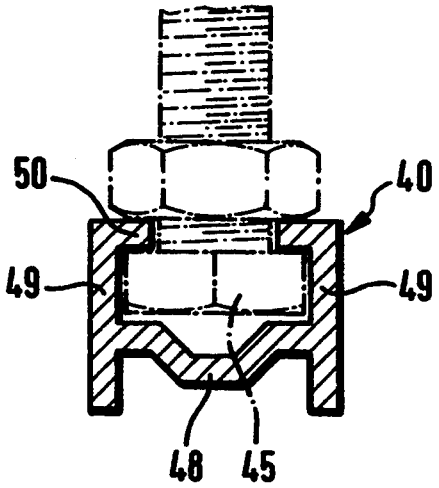
FIGS. 7 and 8 are cross-sections through profile sections used in the invention.

The profile section 40 has a substantially C-shaped design, comprising a crossbar 48, upwardly directed arms 49, and edge flanges 50 (see FIG. 7). A bend in the crossbar 48 allows for the arrangement of fixing screws 51 without having an adverse effect on the displaceability of the screw head 45 in the profile section during mounting.

Figure 8:
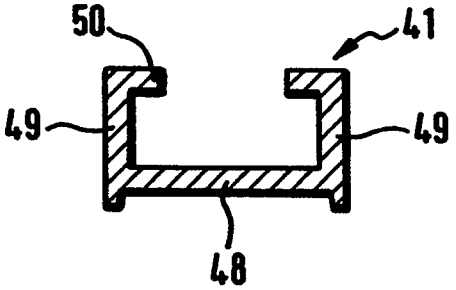

FIG. 8 shows a simplified embodiment of a C-shaped profile section 41.

In FIG. 5, dotted lines 52 indicate a groove which is arranged in side parts beside the door 33. This groove 52 is thus situated at the side of the sealing strip 8, the magnetic counterpart 37 and the fixing means 53 arranged in the door 33. The groove 52 can then receive a rectangular profile which completely fills the groove 52 and also extends into the groove 7. In this manner, the rail 1 according to the invention can also be used for mounting side portions of this kind beside the door, this then being advantageous if these side portions consist of wood.

During mounting of the rail 1 and the insulating sheet 19 on the angled plate 42, it is advisable to fill the space 54 behind the angled plate 42 with assembly foam which also extends into the space between the two arms 5,6.

Figure 6:
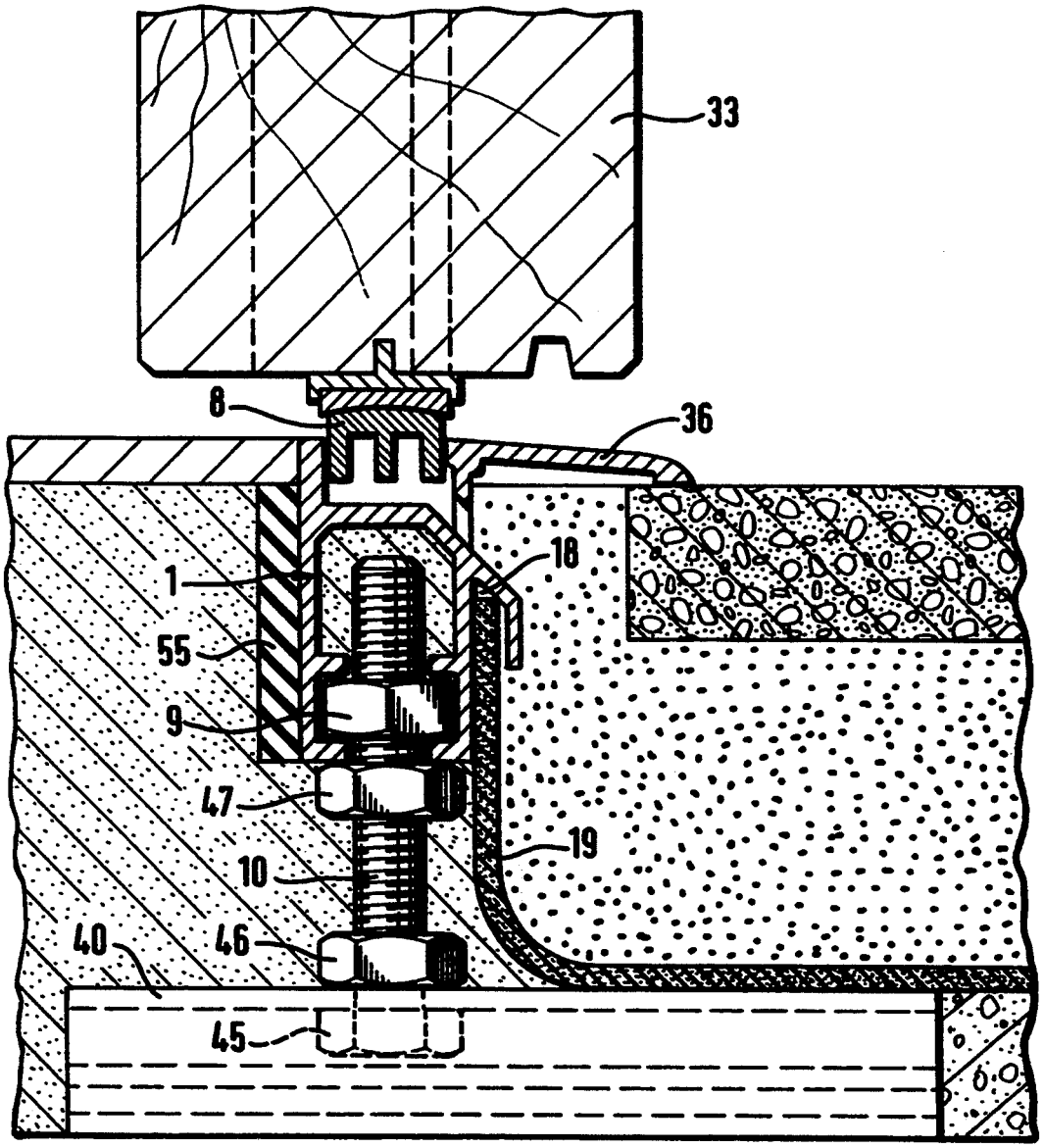

The embodiment according to FIG. 6 of the invention is a variant which is preferably used on external doors. Insulation 55 is provided on the inner face of the rail 1 and is rigidly connected to the rail 1.

I claim:

1. Device for dividing coverings on a floor at a door opening, the coverings being laid on a sub-floor, said device comprising:

a rail adapted to be sunk into the floor across the door opening, said rail having a substantially uniform H-shaped cross-section comprising a cross-member with first arms extending upwardly therefrom and second arms extending downwardly therefrom, said first arms and said cross-member defining a first groove and said second arms defining a second groove;

a magnetic sealing strip received within said first groove and vertically moveable within said first groove;

a set screw adapted to be mounted on the sub-floor and extending upwardly into said second groove;

a polygonal nut engaged with said set screw, said nut being received within said second groove; and guide means provided within said second groove to guide and retain said nut and to adjustably support said rail on said nut.

2. Device according to claim 1, wherein said guide means comprise opposing U-shaped receiving grooves in the internal faces of said second groove.

3. Device according to claim 1, wherein there is further provided at least one dovetailed groove on one of said second arms, and a strip received within said dovetailed groove for fixing said rail to the internal face of the door opening.

4. Device according to claim 1, wherein said set screw has a base plate at its lower end.

5. Device according to claim 4, wherein a profile section with a C-shaped cross section serves as said base plate.

6. Device according to claim 1, wherein one of said second arms has an extension, and there are provided breaking notches at which said extension can be broken off.

7. Device according to claim 1, wherein an outer face of one of said second arms is provided with a downwardly-open groove adapted to receive an insulating sheet.

8. Device according to claim 7, wherein said downwardly open groove also receives an angled plate for supporting said insulating sheet.

9. Device according to claim 1, wherein said first groove has lateral outlet openings on its base.

10. Device according to claim 1, further comprising a cover strip, said cover strip having two clamping bars which engage in recesses provided in said sealing strip and clamp said sealing strip in said first groove under deformation.

* * * * *